US008528347B2

(12) United States Patent
Chen et al.

(10) Patent No.: US 8,528,347 B2
(45) Date of Patent: Sep. 10, 2013

(54) METHOD FOR CONTROLLING FREEZING CAPACITY OF A FIXED-FREQUENCY AC ICE-WATER SYSTEM

(75) Inventors: Shyang-Yih Chen, Taipei (TW); Yu-Huan Wang, Taipei (TW); Chen-Kun Hsu, Taipei (TW); Ming-Hsien Pan, Taipei (TW); Pin-Chuan Chen, Taipei (TW); Ya-Ru Yang, Taipei (TW); Yan-Shao Lin, Taipei (TW)

(73) Assignee: Chunghwa Telecom Co., Ltd., Taipei (TW)

( * ) Notice: Subject to any disclaimer, the term of this patent is extended or adjusted under 35 U.S.C. 154(b) by 385 days.

(21) Appl. No.: 12/904,838

(22) Filed: Oct. 14, 2010

(65) Prior Publication Data

US 2012/0000214 A1 Jan. 5, 2012

(30) Foreign Application Priority Data

Jun. 30, 2010 (TW) ..... 99121400 A

(51) Int. Cl.
*F25C 1/00* (2006.01)

(52) U.S. Cl.
USPC ..... 62/66; 62/342

(58) Field of Classification Search
USPC ..... 62/66, 342, 340, 348, 440
See application file for complete search history.

(56) References Cited

U.S. PATENT DOCUMENTS

| | | | | | |
|---|---|---|---|---|---|
| 3,772,895 | A | * | 11/1973 | Abendroth | 62/53.2 |
| 3,845,637 | A | * | 11/1974 | Shepherd | 62/155 |
| 4,142,373 | A | * | 3/1979 | Weibel et al. | 62/138 |
| 4,280,335 | A | * | 7/1981 | Perez et al. | 62/332 |
| 4,798,061 | A | * | 1/1989 | LaConte | 62/348 |
| 4,979,647 | A | * | 12/1990 | Hassell | 222/146.6 |
| 5,033,272 | A | * | 7/1991 | Yoshikawa et al. | 62/199 |
| 5,259,201 | A | * | 11/1993 | Sakai et al. | 62/135 |
| 5,511,388 | A | * | 4/1996 | Taylor et al. | 62/389 |
| 5,587,055 | A | * | 12/1996 | Hartman et al. | 203/1 |
| 5,709,470 | A | * | 1/1998 | Finley | 374/16 |
| 5,826,432 | A | * | 10/1998 | Ledbetter | 62/196.4 |
| 5,842,355 | A | * | 12/1998 | Kalis et al. | 62/234 |
| 6,096,355 | A | * | 8/2000 | Lesellier et al. | 426/129 |
| 6,129,141 | A | * | 10/2000 | Yang | 165/45 |
| 6,389,841 | B1 | * | 5/2002 | Feldman et al. | 62/476 |
| 6,981,387 | B1 | * | 1/2006 | Morgan | 62/390 |
| 7,260,956 | B1 | * | 8/2007 | Schabron et al. | 62/371 |

* cited by examiner

*Primary Examiner* — Mohammad Ali

(57) ABSTRACT

A method for controlling the freezing capacity of a fixed-frequency freezing AC ice-water system, by using temperature buffer difference of individual requirement ends to control the number of operating compressors in a fixed-frequency chiller and make each of the operating compressors have a usage rate close to 100%. Further, various operating procedures are defined for the requirement ends and each of the operating procedures has an individually defined high-low temperature range such that the freezing capacity supply cycle or startup cycle of the fixed-frequency chiller can be adjusted by using the high-low temperature ranges of the operating procedures as temperature buffer strips, thereby allowing the compressors in the fixed-frequency chiller to operate collectively in order to save energy.

10 Claims, 3 Drawing Sheets

METHOD FOR CONTROLLING FREEZING CAPACITY OF A FIXED-FREQUENCY AC ICE-WATER SYSTEM

BACKGROUND OF THE INVENTION

1. Field of the Invention

The present invention relates generally to methods for controlling the freezing capacity of freezing AC ice-water systems, and more particularly, to a method for controlling the freezing capacity of a fixed-frequency freezing AC ice-water system.

2. Description of Related Art

Generally, requirement ends in business places or office buildings for temperature control (e.g. air conditioners, central air conditioning systems, freezers, refrigerators etc.) require large power output to achieve a sufficient cooling effect. Several requirement ends in a business place are usually connected to a rear end chiller and exchange heat with the chiller for achieving desired cooling effects. For example, freezers and refrigerators in a supermarket or a warehouse are connected to a rear end chiller so as to allow heat exchange to occur therebetween through a cooling fluid provided by the chiller, thereby achieving freezing and refrigerating effects.

In practice, a chiller usually supplies a huge freezing capacity, which thus results in high electric power consumption. For example, a chiller in a supermarket supplies several tons to several hundreds of tons of freezing capacity, thereby resulting in high electric power consumption and high cost. If the freezing capacity during startup of the chiller can be effectively utilized and the number of startup and shutdown events can be reduced, the freezing cost can be greatly reduced.

Accordingly, a fixed-frequency chiller with a plurality of compressors is developed, wherein the number of operating compressors varies with the total supply of freezing capacity so as to reduce electric power consumption and save cost. It is because that the supply of freezing capacity of the fixed-frequency chiller is positively proportional to the number of operating compressors, and each of the operating compressors operates at full speed once it starts up. That is, each of the compressors of the fixed-frequency chiller is completely started up (as shown at point A of FIG. 1) or completely shut down (as shown at point B of FIG. 1). FIG. 1 is a plot showing the relationship between the electric power consumption and freezing capacity supply of a typical fixed-frequency chiller. When one of the compressors of the fixed-frequency chiller starts to operate, it operates at the maximum freezing capacity and has an electric power consumption of 100% of the rated power. By increasing the number of operating compressors according to the required total supply of freezing capacity, the fixed-frequency chiller achieves an operating effect similar to that of a variable-frequency chiller. However, along with continuing global warming, only using such a fixed-frequency chiller with the number of operating compressors varied according to the required total supply of frequency capacity cannot meet the high demand for carbon emission reduction.

Therefore, it is imperative to provide a method for controlling the freezing capacity of a fixed-frequency freezing AC ice-water system so as to overcome the above-described drawbacks.

SUMMARY OF THE INVENTION

In view of the above drawbacks of the prior art, an object of the present invention is to improve the energy-saving effect of a fixed-frequency chiller by utilizing the operating characteristics of a plurality of compressors of the fixed-frequency chiller.

Another object of the present invention is to enable the compressors to operate collectively so as to increase the cooling efficiency and save electric power consumption.

In order to achieve the above and other objects, the present invention provides a method for controlling freezing capacity of a fixed-frequency freezing AC ice-water system having a plurality of supply ends and a plurality of requirement ends, wherein each of the requirement ends has individual current temperature and temperature loss rate and operates according to a corresponding operating procedure. The method comprises the steps of (1) defining the operating procedures corresponding to the requirement ends, respectively, such that each of the operating procedures has a corresponding defined high-low temperature range; (2) having at least one of the supply ends supply a total freezing capacity currently required by the requirement ends so as to maintain the current temperatures of the requirement ends within the respective corresponding high-low temperature ranges for a current time period; (3) assessing the temperature rising time for the individual temperature of each of the requirement ends to rise to the upper limit of the corresponding high-low temperature range according to the current temperature and temperature loss rate of each of the requirement ends; (4) determining whether the difference between the temperature rising time of any two of the requirement ends is greater than a certain value; if yes, having the supply ends perform a pre-cooling procedure to the requirement end that has the shortest temperature rising time so as to reduce the temperature thereof and then returning to step (3), otherwise, proceeding to step (5); and (5) when the individual current temperatures of the requirement ends rise to the upper limit of the respective corresponding upper-lower temperature ranges at the same time, having at least one of the supply ends supply a predetermined total freezing capacity to reduce the individual current temperatures of the requirement ends, thereby maintaining the requirement ends within the respective corresponding high-low temperature ranges for a predetermined time period.

In an embodiment, the predetermined total freezing capacity supplied from the supply ends further comprises pipeline loss such as a damaged pipeline or an uneven pipeline.

In an embodiment, the high-low temperature range of each of the operating procedures further comprises a secondary high-low temperature range. And, temperature values of the high-low temperature range and secondary high-low temperature range are set according to the corresponding operating procedure and used as a temperature buffer strip of the corresponding operating procedure.

In an embodiment, a round-robin algorithm is used for controlling the requirement ends so as to make the requirement ends take turns in performing different operating procedures. Alternatively, a weighted algorithm is used for controlling the requirement ends so as to make the requirement ends take turns in performing different operating procedures according to the properties of the requirement ends.

Compared with the prior art, the method of the present invention utilizes the temperature buffer difference between any two of the requirement ends to control the number of operating compressors of a fixed-frequency chiller and make each of the operating compressors have a usage rate close to 100%. The method of the present invention can be applied to an air conditioner or a chilling system with a fixed-frequency chiller so as to change the operating efficiency of the fixed-frequency chiller and reduce electric power consumption and further improve the cooling efficiency and cost-effectiveness thereof.

DETAILED DESCRIPTION OF PREFERRED EMBODIMENTS

The following illustrative embodiments are provided to illustrate the disclosure of the present invention, these and other advantages and effects can be apparent to those in the art after reading this specification.

Figure 1:
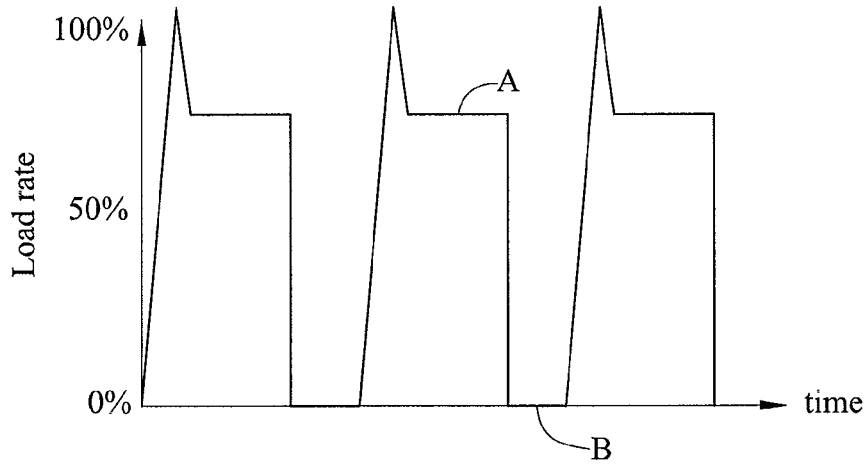
FIG. 1 is a plot illustrating the relationship between the electric power consumption and load rate of a typical fixed-frequency chiller.
Figure 2A:
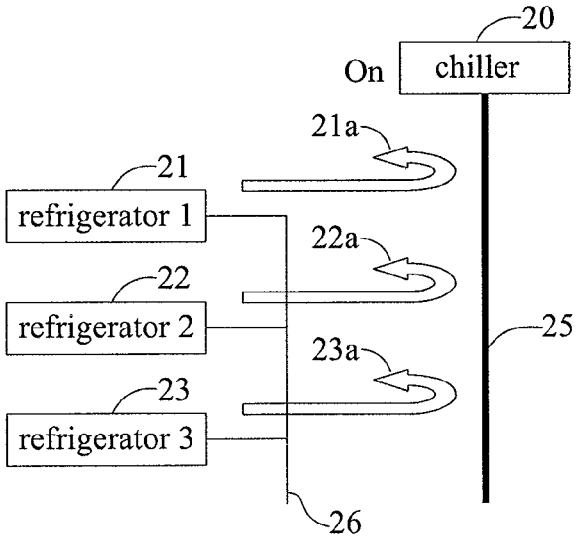
FIGS. 2A and 2B are diagrams showing an application structure of a method for controlling the freezing capacity of a fixed-frequency freezing AC ice-water system of the present invention.
Figure 2B:
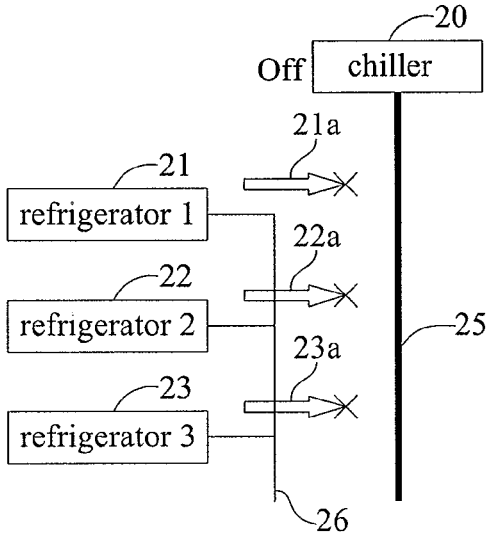

FIG. 2A shows an application structure of a method for controlling the freezing capacity of a fixed-frequency AC ice-water system, wherein the fixed-frequency AC ice-water system comprises a fixed-frequency freezing capacity supply end (chiller) 20 and a plurality of requirement ends 21, 22, 23. Referring to FIG. 2A, the supply end 20 is at ON state and heat exchanges 21*a*, 22*a*, 23*a* occur between the requirement ends 21, 22, 23 and the supply end 20 through an ice-water pipeline 25 so as to achieve desired cooling effects. Referring to FIG. 2B, the supply end 20 is at OFF state and no heat exchange occurs between the requirement ends 21, 22, 23 and the supply end 20.

In the present invention, the freezing capacity supplied by the supply end 20 is defined as:

ice-water flow×ice-water specific heat×(temperature difference between inlet and outlet)

wherein the ice-water specific heat is the specific heat of the ice-water provided by the supply end 20, the temperature difference between inlet and outlet is the temperature difference between the ice-water provided by the ice-water pipeline 25 and the returning ice-water. Therefore, when the temperature difference between inlet and outlet is greater than a specific value, it means that the requirement ends 21, 22, 23 require more freezing capacity. Accordingly, the supply end 20 can increase the ice-water flow to increase the supply of freezing capacity, reduce the temperature difference between inlet and outlet and achieve desired freezing effects at the requirement ends.

In the present embodiment, once the supply end 20 starts up, it operates at 100% load rate. The requirement ends 21, 22, 23 can comprise, for example, air conditioners, central air conditioning systems, fresh food freezers, and fruit and vegetable refrigerators. The freezing capacity demands of the requirement ends 21, 22, 23 are collected together so as to greatly reduce the load cycles of the fixed-frequency chiller and thereby enhance the energy-saving efficiency.

In addition, one or more supply ends 20 can be provided in the present embodiment.

In the present embodiment, each of the requirement ends 21, 22, 23 has its individual current temperature and temperature loss rate and operates under a corresponding operating procedure. The temperature loss rate of each of the requirement ends 21, 22, 23 depends on a lot of factors such as the characteristic of the requirement end, background environmental temperature, a damaged pipeline and so on.

The temperature loss rates of the requirement ends 21, 22, 23 can be monitored through a monitor end 26 such that the freezing capacity demands of the requirement ends can be timely adjusted. Besides monitoring or measuring the states of the requirement ends, the monitor end 26 can set the operating procedures of the requirement ends, but it is not limited thereto. In other embodiments, different requirement ends can have respective corresponding monitor ends. Alternatively, some of the requirement ends have individual monitor ends, and others share a common monitor end.

In the present embodiment, the operating procedures are defined corresponding to the requirement ends 21, 22, 23, respectively, such that each of the operating procedures has an individually defined high-low temperature range. For example, each of the requirement ends 21, 22, 23 has a different operating temperature range. In particular, the requirement end 21 can be such as an air conditioner with an operating temperature range between 23° C. and 28° C., the requirement end 22 can be such as a fruit and vegetable refrigerator with an operating temperature range between 2° C. and 7° C., and the requirement end 23 can be such as a server room with an operating temperature range between 20° C. and 25° C.

The supply end 20 supplies a total freezing capacity currently required by the requirement ends 21, 22, 23 to maintain the individual current temperatures $T_{21}$, $T_{22}$, $T_{23}$ of the requirement ends 21, 22, 23 within the respective corresponding high-low temperature ranges for a current time period.

Further, according to the individual temperature and temperature loss rate of each of the requirement ends 21, 22, 23, the temperature rising time for the individual current temperature of each of the requirement ends 21, 22, 23 to rise to the upper limit of the corresponding high-low temperature range is assessed.

If the difference between the temperature rising time of any two of the requirement ends 21, 22, 23 is greater than a certain value, the supply end 20 performs a pre-cooling procedure to the requirement end that has the shortest temperature rising time so as to reduce the temperature thereof. Then, the time for the individual current temperature of each of the requirement ends 21, 22, 23 to rise to the upper limit of the corresponding high-low temperature range is reassessed until the difference between the rise time of the requirement ends 21, 22, 23 is less than the certain value.

If the individual current temperatures of the requirement ends 21, 22, 23 rise to the upper limits of the respective corresponding high-low temperature ranges at the same time or there is little difference between the temperature rising time of the requirement ends 21, 22, 23, at least one supply end 20 supplies a predetermined total freezing capacity to the requirement ends 21, 22, 23 for reducing the individual current temperatures of the requirement ends 21, 22, 23 and thereby maintaining the individual current temperatures of the requirement ends 21, 22, 23 within the respective corresponding high-low temperature ranges for a predetermined time period.

For example, according to the individual current temperature and temperature loss rate of each of the requirement ends 21, 22, 23, the temperature rising time for the individual current temperature of each of the requirement ends 21, 22, 23 to rise to the upper limit of the corresponding high-low temperature range is assessed. If the difference between the temperature rising time of any two of the requirement ends 21, 22, 23 is greater than a certain value, the method of the present invention utilizes the high-low temperature range of the operating procedure of each of the requirement ends 21, 22, 23 as a temperature buffer strip to reduce the temperature of the requirement end that has the shortest temperature rising time and reassesses the rise time until the difference between the temperature rising time of each of the requirement ends 21, 22, 23 is less than the certain value. As such, the method of the present invention can be applied to various kinds of fixed-frequency chillers so as to allow the fixed-frequency chillers to operate collectively, thereby achieving an energy-saving effect.

Figure 3:
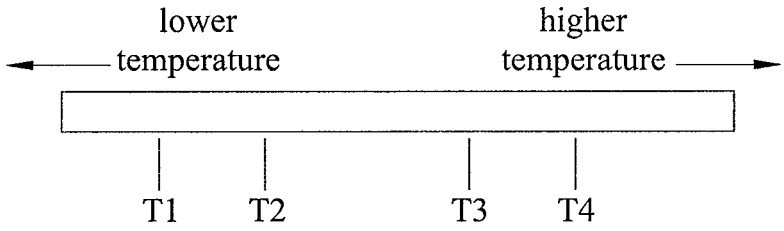
FIG. 3 is a diagram showing the operating temperature range of a requirement end according to different operating procedures.

FIG. 3 is a diagram showing the operating temperature range of a requirement end according to different operating procedures. Referring to FIG. 3, T1 is the lower limit of a high-low temperature range (lowest temperature point), T2 is the lower limit of a secondary high-lower temperature range, T3 is the upper limit of the secondary high-lower temperature range, and T4 is the upper limit of the high-low temperature range (highest temperature point). Different operating temperature ranges can be set according to different requirements of the requirement ends.

For example, the requirement ends 21, 22, 23 of FIGS. 2A and 2B can be set to operate under different operating procedures. In general, the operating procedures comprise, but not limited to, general operating procedures, pre-cooling procedures and deviation permit procedures.

Each of the general operating procedures is managed to maintain the temperature of the corresponding requirement end within the corresponding high-low temperature range. For example, the temperature of a fruit and vegetable refrigerator can be maintained between 2° C. and 7° C. Each of the pre-cooling procedures is managed to pre-cool the corresponding requirement end. Each of the deviation permit procedures is managed to maintain the current temperature of the corresponding requirement end within the corresponding high-low temperature range, such that when the current temperatures exceed the corresponding secondary high-low temperature range for a permit time period, the deviation permit procedure cools or stops cooling the requirement end so as to maintain the current temperature thereof within the corresponding secondary high-low temperature range. For example, the current temperature of a fruit and vegetable refrigerator can be maintained between 3° C. and 6° C. (secondary high-low temperature range). Further, in order to control the freezing capacity or save electric power, the current temperature of the fruit and vegetable refrigerator can be maintained between 0° C. and 2° C. or 8° C. and 9° C., wherein the high-low temperature range is 0° C. and 9° C.

Figure 4A:
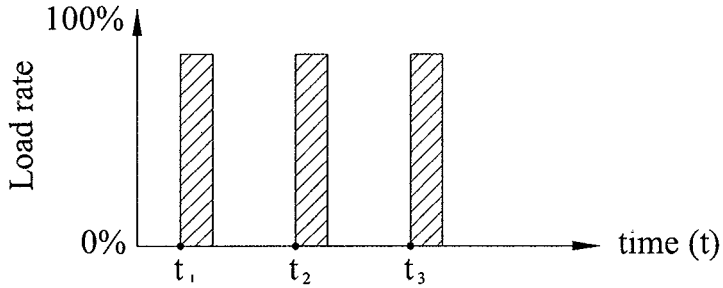
FIGS. 4A and 4B are diagrams showing adjustment of the freezing capacity supplied from a plurality of supply ends to a plurality of requirement ends according to the method of the present invention.
Figure 4B:
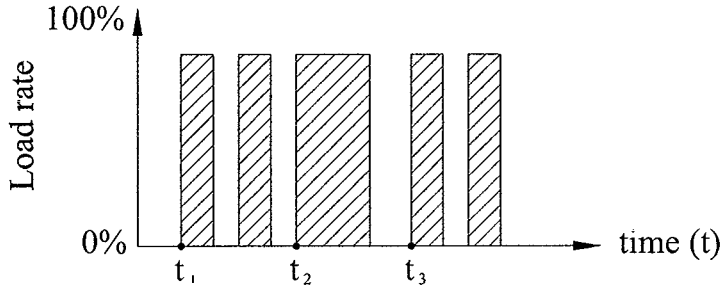

FIGS. 4A and 4B are diagrams showing control of the startup cycle of the supply end 20 according to the method of the present invention.

Referring to FIG. 4B, the startup cycle of the supply end 20 at time units t1, t2 and t3 is quite frequent, which mainly because the background environmental temperatures of the requirement ends 21, 22, 23 may continuously change (e.g. air temperature changes), or an external heat source appears (e.g. vegetables with higher temperature are put into the fruit and vegetable refrigerator of the requirement end 23). As shown in FIG. 4B, the compressor of the supply end 20 is started up twice between the time units t1 and t2, and the startup time of the compressor of the supply end 20 between the time units t2 and t3 is more than twice the startup time of the compressor between other time units. Therefore, the supply end 20 needs to be started up frequently to provide required freezing capacities to the requirement ends 21, 22, 23. However, such a frequent startup cycle increases the power consumption of the supply end 20. On the other hand, referring to FIG. 4A, the method of the present invention collectively controls the number of startup of the supply end 20 at individual time units t1, t2, t3 to reduce the startup frequency. The startup frequency of the compressor of the supply end 20 between the time units t1 and t2 and between t2 and t3 in FIG. 4A is obviously less than those in FIG. 4B. Therefore, the method of the present invention allows the fixed-frequency chiller to operate collectively so as to reduce the startup frequency of the supply end 20 at a fixed time period, thereby improving the energy-saving and supply efficiency.

By assessing the rise time of the requirement ends 21, 22, 23, the method of the present invention determines which one of the requirement ends is to be firstly supplied with freezing capacity by the supply end 20 and then causes the supply end 20 to perform a pre-cooling procedure to the requirement end so as to reduce the temperature thereof. As such, the time points for the supply of freezing capacities from the supply end 20 to the requirement ends 21, 22, 23 can be adjusted to reduce the supply frequency of the supply end 20 and centralize the startup cycles. That is, after the supply end 20 starts to operate, it can collectively supply the freezing capacity to the requirement ends 21, 22, 23 such that the power generated by the supply end 20 can be effectively utilized. Since the startup cycle of FIG. 4B is obviously frequent than that of FIG. 4A, the method of the present invention improves the energy-saving efficiency of the fixed-frequency chiller.

Therefore, by flexibly utilizing the characteristic that the requirement ends can operate under different operating procedures, the method of the present invention can effectively centralize the startup cycles of the fixed-frequency chiller 20 (supply end). In addition, the method of the present invention takes into account pipeline loss so as to compensate for freezing capacity deficiency caused by such as damaged pipelines or the like.

Figure 5:
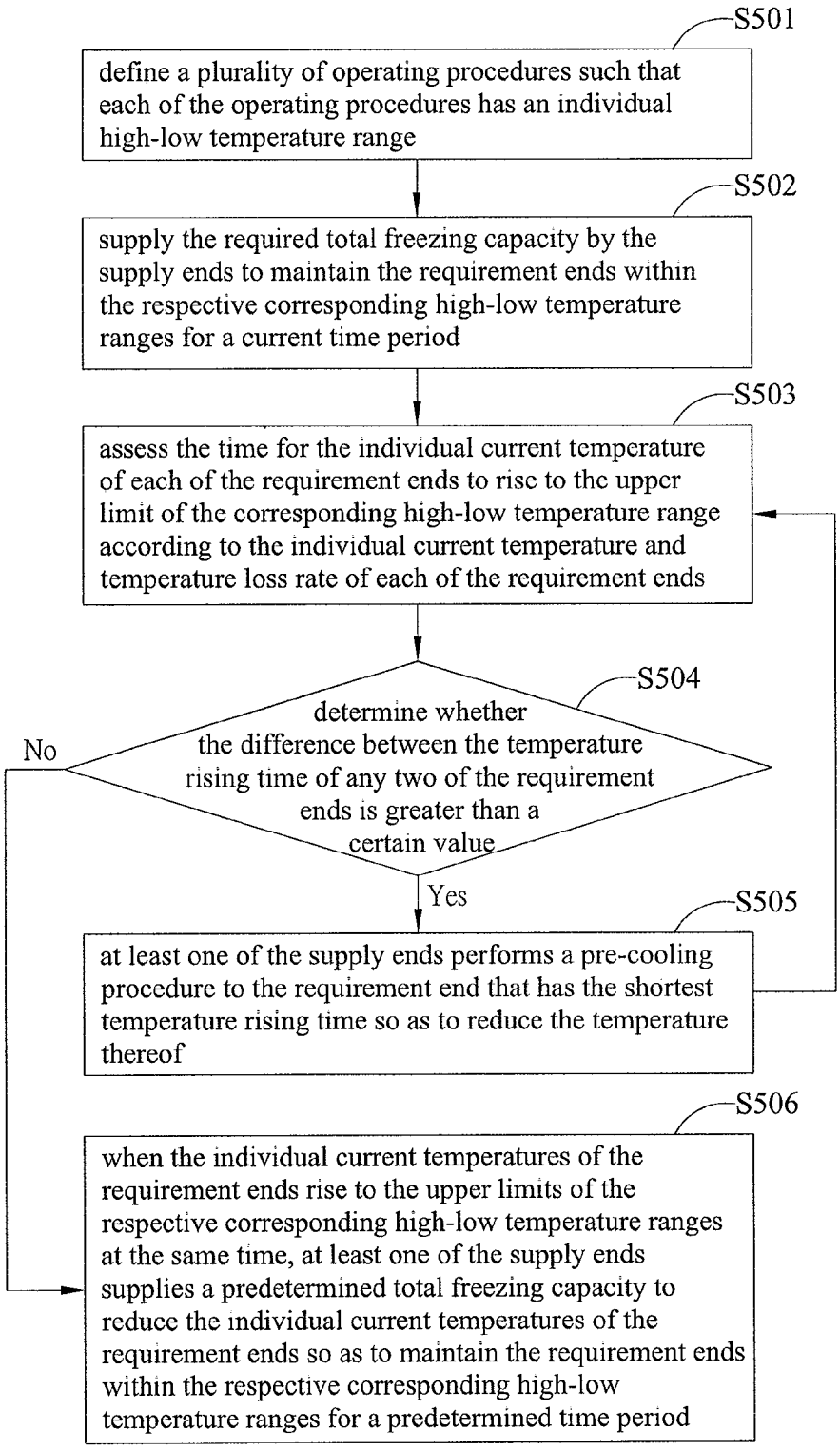
FIG. 5 is a flow diagram showing the method for controlling the freezing capacity of a fixed-frequency AC ice-water system according to the present invention.

FIG. 5 is a flow diagram showing the method for controlling the freezing capacity of a fixed-frequency AC ice-water system according to the present invention. The method is applied to an ice-water system having one or more supply ends and one or more requirement ends, wherein each of the requirement ends have individual current temperature and temperature loss rate and operates under a corresponding operating procedure.

Referring to FIG. 5, at step S501, a plurality of operating procedures is defined such that each of the operating procedures has a defined corresponding high-low temperature range. Then, the process proceeds to step S502.

At step S502, the supply ends supply a currently required total freezing capacity so as to maintain the requirement ends within the respective corresponding high-low temperature ranges for a current time period. Then, the process proceeds to step S503.

At step S503, according to the individual current temperature and temperature loss rate of each of the requirement ends, the temperature rising time for the individual current temperature of each of the requirement ends to rise to the upper limit of the corresponding high-low temperature range is assessed. Then, the process proceeds to step S504.

At step S504, whether the difference between the temperature rising time of any two of the requirement ends is greater than a certain value is determined; if yes, the process proceeds to step S505, otherwise, if the difference between the temperature rising time of the requirement ends is less than the certain value, the process proceeds to step S506.

At step S505, at least one of the supply ends performs a pre-cooling procedure to the requirement end that has the shortest temperature rising time so as to reduce the temperature thereof. Then, the process proceeds to step S503.

At step S506, when the individual current temperatures of the requirement ends rise to the upper limits of the respective corresponding high-low temperature ranges at the same time, at least one of the supply ends supplies a predetermined total freezing capacity to reduce the individual current temperatures of the requirement ends to maintain the requirement ends within the corresponding high-low temperature ranges for a predetermined time period.

Compared with the prior art, the method of the present invention effectively utilizes the characteristic that a fixed-frequency chiller operates at full speed once it starts up so as to allow the compressors thereof to operate collectively at a lower startup frequency, thereby improving the cooling efficiency and reducing electric power consumption. By using the temperature buffer difference of individual requirement ends, the method of the present invention controls the number of operating compressors of the fixed-frequency chiller and makes each of the operating compressors have a usage rate close to 100%. The method of the present invention can be applied to an air conditioner or a chilling system with a fixed-frequency chiller so as to improve the operating efficiency of the chiller and reduce electric power consumption and further improve the cooling efficiency and cost-effectiveness thereof. The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A method for controlling freezing capacity of a fixed-frequency freezing AC ice-water system having a plurality of supply ends and a plurality of requirement ends, wherein each of the requirement ends has individual current temperature and temperature loss rate and operates according to a corresponding operating procedure, the method comprising the steps of:

(1) defining the operating procedures corresponding to the requirement ends, respectively, such that each of the operating procedures has a corresponding defined high-low temperature range;

(2) having at least one of the supply ends supply a total freezing capacity currently required by the requirement ends so as to maintain the current temperatures of the requirement ends within the respective corresponding high-low temperature ranges for a current time period;

(3) assessing temperature rising time for the individual current temperature of each of the requirement ends to rise to an upper limit of the corresponding high-low temperature range according to the current temperature and temperature loss rate of each of the requirement ends;

(4) determining whether difference between the temperature rising time of any two of the requirement ends is greater than a certain value; if yes, having the supply ends perform a pre-cooling procedure to the requirement end that has the shortest temperature rising time so as to reduce temperature thereof and returning to step (3), otherwise, proceeding to step (5); and (5) when the individual current temperatures of the requirement ends rise to the upper limits of the respective corresponding upper-lower temperature ranges at the same time, having at least one of the supply ends supply a predetermined total freezing capacity to reduce the individual current temperatures of the requirement ends, thereby maintaining the requirement ends within the respective corresponding high-low temperature ranges for a predetermined time period.

2. The method of claim 1, wherein the current total freezing capacity further comprises pipeline loss.

3. The method of claim 1, wherein the predetermined total freezing capacity further comprises pipeline loss.

4. The method of claim 1, wherein the high-low temperature range of each of the operating procedures further comprises a secondary high-low temperature range, and temperature values of the high-low temperature range and secondary high-low temperature range are set according to the corresponding operating procedure.

5. The method of claim 4, wherein the operating procedures comprise general operating procedures, pre-cooling procedures and deviation permit procedures, wherein each of the general operating procedures is managed to maintain the current temperature of the corresponding requirement end within the corresponding high-low temperature range, each of the pre-cooling procedures is managed to pre-cool the corresponding requirement end, and each of the deviation permit procedures is managed to maintain the current temperature of the corresponding requirement end within the corresponding high-low temperature range, such that when the current temperatures exceeds the corresponding secondary high-low temperature range for a permit time period, the deviation permit procedure cools or stops cooling the requirement end so as to maintain the current temperature thereof within the corresponding secondary high-low temperature range.

6. The method of claim 1, wherein step (1) further comprises controlling the requirement ends through a round-robin algorithm so as to cause the requirement ends to take turns in performing different operating procedures.

7. The method of claim 1, wherein step (1) further comprises having the requirement ends to perform different operating procedures according to properties of the requirement ends.

8. The method of claim 1, wherein step (1) further comprises controlling the requirement ends through a weighted algorithm so as to make the requirement ends take turns in performing different operating procedures according to properties of the requirement ends.

9. The method of claim 1, wherein the supply ends are fixed-frequency chillers.

10. The method of claim 1, wherein the requirement ends are refrigerators, freezers, blowers and/or air conditioners.

* * * * *